US005377982A

United States Patent [19]

Villarreal, Jr.

[11] Patent Number: 5,377,982

[45] Date of Patent: Jan. 3, 1995

[54] PORTABLE ELECTRONIC SCOREKEEPING DEVICE

[76] Inventor: Oscar Villarreal, Jr., 807 Ebony Dr., Harlingen, Tex. 78550

[21] Appl. No.: 116,501

[22] Filed: Sep. 3, 1993

[51] Int. Cl.[6] ..... G06F 15/40; A63F 9/22; A63B 71/04

[52] U.S. Cl. ..... 273/148 R; 273/88; 273/DIG. 26

[58] Field of Search ..... 273/148 R, 85 G, 88, 273/94, DIG. 26; 364/410, 411; 340/323 R

[56] References Cited

U.S. PATENT DOCUMENTS

D. 297,714 9/1988 Tamada et al. .
3,594,778 7/1971 Herald et al. ..... 340/337
4,302,010 11/1981 Kaenel .
4,496,148 1/1985 Morstain et al. ..... 273/85 G
4,824,109 4/1989 Cervantes .
4,868,772 9/1989 Collard .
4,890,229 12/1989 Rudnick et al. ..... 273/88
4,948,125 8/1990 Mayes .
4,977,503 12/1990 Rudnick et al. ..... 273/88
5,153,826 10/1992 Johnson ..... 364/410

*Primary Examiner*—Jessica J. Harrison
*Attorney, Agent, or Firm*—Richard C. Litman

[57] ABSTRACT

A portable electronic scorekeeper for a game is disclosed which allows the user to electronically document and record the plays and scoring in a game. The information regarding each play is manually input by the user via a keyboard. This information is then used to automatically update statistics for the pitcher, the batter and the fielders for immediate display.

15 Claims, 8 Drawing Sheets 4-6
BATTER AND/OR RUNNER OUT
Y
INCREMENT OC
CALCULATE STATS RESET BC=0, SC=0
N
NEXT BATTER
G
BALL?
Y
INCREMENT BC
DOES BC=4?
Y
BATTER AND RUNNERS ADVANCE
N
G
N
STRIKE?
Y
INCREMENT SC
DOES SC=3?
Y
INCREMENT OC
N
G
N
BATTER HIT?
Y
ADVANCE BATTER AND RUNNER
CALCULATE STATS RESET BC=0 SC=0
NEXT BATTER
G
N
ATTEMPTED STOLEN BASE?
Y
SAFE?
Y
ADVANCE RUNNER
G
6-7
N
G
N
INCREMENT OC
6-8

PORTABLE ELECTRONIC SCOREKEEPING DEVICE

BACKGROUND OF THE INVENTION

1. Field of the Invention

The present invention relates to a portable electronic scoring device for sports. At the present time the score is manually written on a special notebook with appropriate score sheets. The scorekeeper fills in the information about the team, its players and the results of each play in the game.

2. Description of the Prior Art

Portable electronic scorekeeping devices are used to keep a running tally of the scores of players or teams during a game and display the results. Such scorekeeping devices require the scorekeeper to enter the results of each play via a keyboard.

U.S. Pat. No. 4,824,109 issued Apr. 25. 1989 to Adan R. Cervantes discloses a portable electronic bowling scorekeeping device which keeps a running tally of each person's score based on the input of the scorekeeper after each play and automatically calculates statistics based on the player's performance.

U.S. Pat. No. 4,302,010 issued Nov. 24. 1981 to Reginald A. Kaenel discloses a manager's console which interfaces and controls the individual lane score keeping console for an electronic bowling scorekeeping system.

U.S. Pat. No. 4,948,125 issued Aug. 14, 1990 to Robert J. Mayes discloses an electronic scorekeeper for a dice Game which keeps a running tally of game scores for a series of names until a predetermined number of games have been reached.

U.S. Pat. No. 4,868,772 issued Sep. 19, 1989 to Thomas H. Collard discloses a calculator for calculating the earned run average for a pitcher and the batting average for a batter.

U.S. Pat. No. Des.297,714 issued Sep. 20, 1988 to Kenji Tamada et al. discloses the ornamental design of a scorekeeper for a baseball game.

None of the above inventions and patents, taken either singly or in combination, is seen to describe the instant invention as claimed.

SUMMARY OF THE INVENTION

The present invention is a portable electronic scorekeeper for a game which allows the user to electronically document the plays and scoring in a game. The information regarding each play is manually input by the user via a keyboard. This information, in the preferred embodiment, is then used to automatically update statistics for the pitcher, the batter and the fielders for immediate display.

Accordingly, it is a principal object of the invention to provide a portable electronic scorekeeping device which automatically calculates and updates the statistics of the players of a baseball game using the documentation of each play event as it is input into the device.

It is another object of the invention to provide bulk storage such as a hard disk to allow information from several games to be readily available.

It is a further object of the invention to provide a printer integral with the device to obtain a hard copy of the stored information, if desired.

Still another object of the invention is to provide an interface for connection to a publicly viewed scoreboard in order to control its display.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

Figure 1:
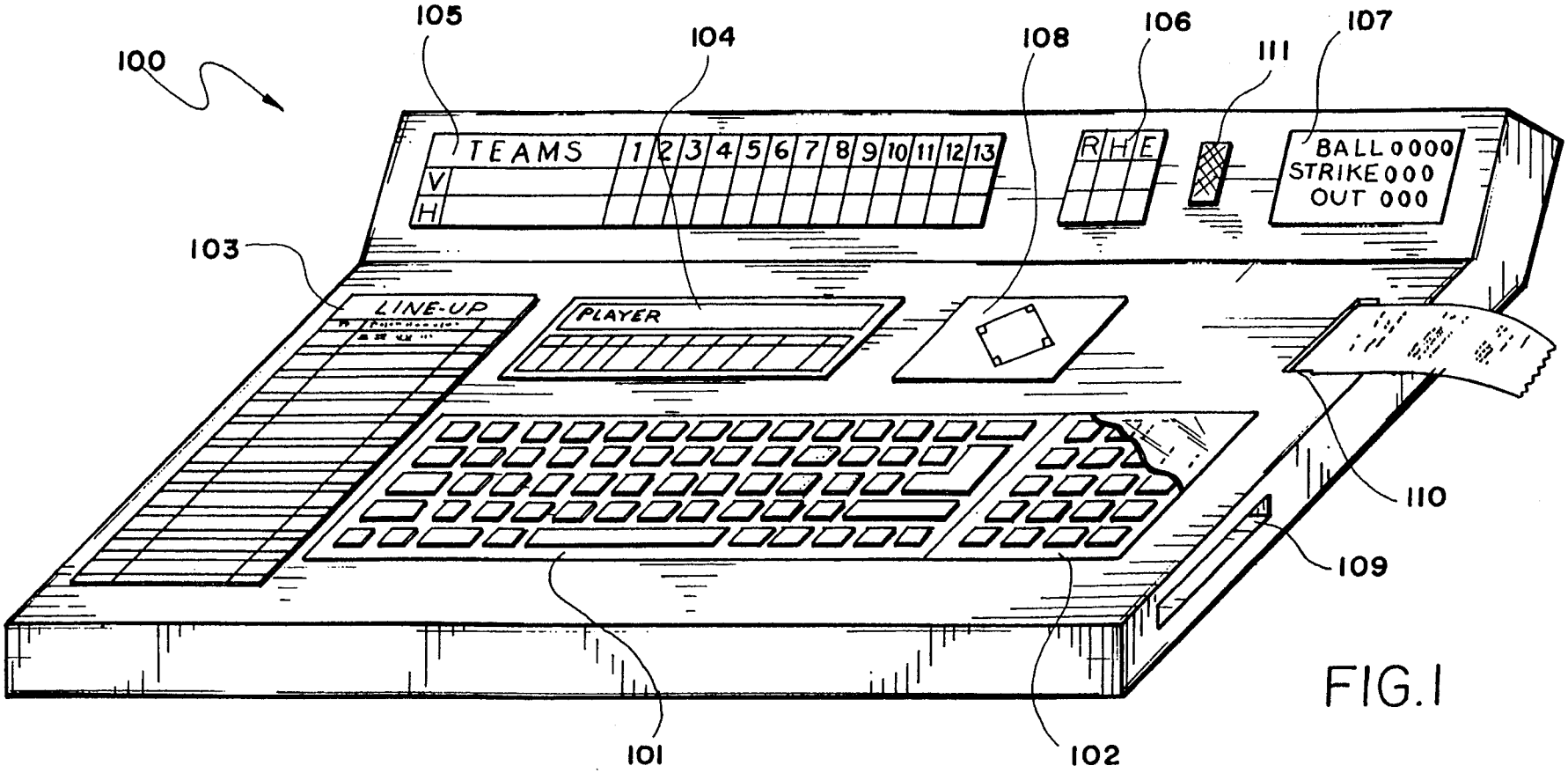
FIG. 1 is perspective view of the present invention.

Referring to FIG. 1, wherein portable electronic scorekeeping device 100 is shown. It features a keyboard 101 for entering alphanumeric data regarding the teams and the individual players thereon. Play event data is entered via function keys 132 in conjunction with keyboard 101.

The function keys 102 include individual keys to record such play events such as a strike, a ball, a single, a double, a triple, a home run, a hit by the pitch, a base on balls, a balk, a sacrifice, a run scored, a wild pitch, an error, a fly out, a double play, a triple play, a strike out; a stolen base, a fielder's choice and a put out.

Display 103 shows the starting line up for a team with each player's defensive position. Display 104 shows an individual player's name along with his current offensive and defensive statistics. Display 105 shows the outcome of each inning for the home team and a visiting team. Display 106 shows the current total of runs, hits and errors for each team. Display 107 shows the current total of ball, strikes and outs. Display 108 shows a baseball diamond to indicate when players are on base. It is contemplated that LED indicators could be used to represent runners on base. Alternatively, a more detailed graphic video display, complete with animation or the like, could be employed by conventional techniques known in the art.

Hard disk drive 109 allows the bulk storage of player data and play events over several games. Printer 110 allows the user to obtain a hard copy of this stored player data and associated play events. Sound emitting means 111 such as a voice synthesizer that is known in the art may provide an audible notification of the input play event and other special events, if desired.

Figure 2:
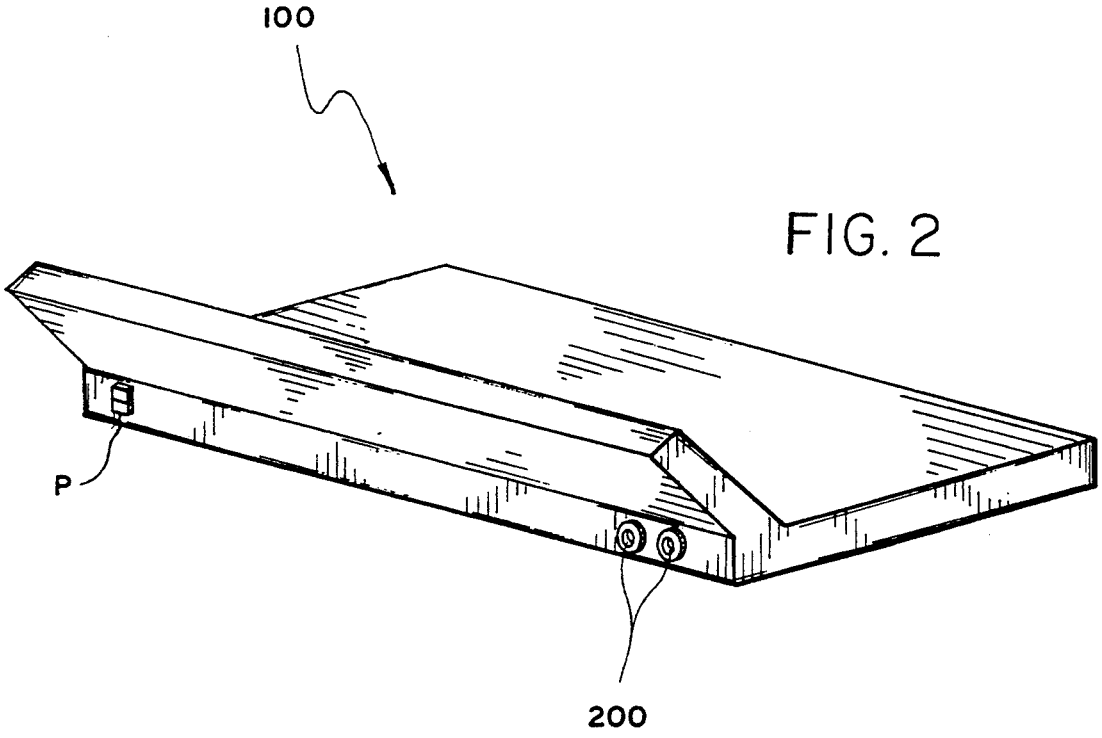
FIG. 2 is a rear view of the present invention.

Referring to FIG. 2, the rear view of the scorekeeping device 100 is shown. Interface ports 200 allow the device to be connected to and thereby run a publicly viewed scoreboard. Power switch P allows the device to be turned on and off.

Figure 3:
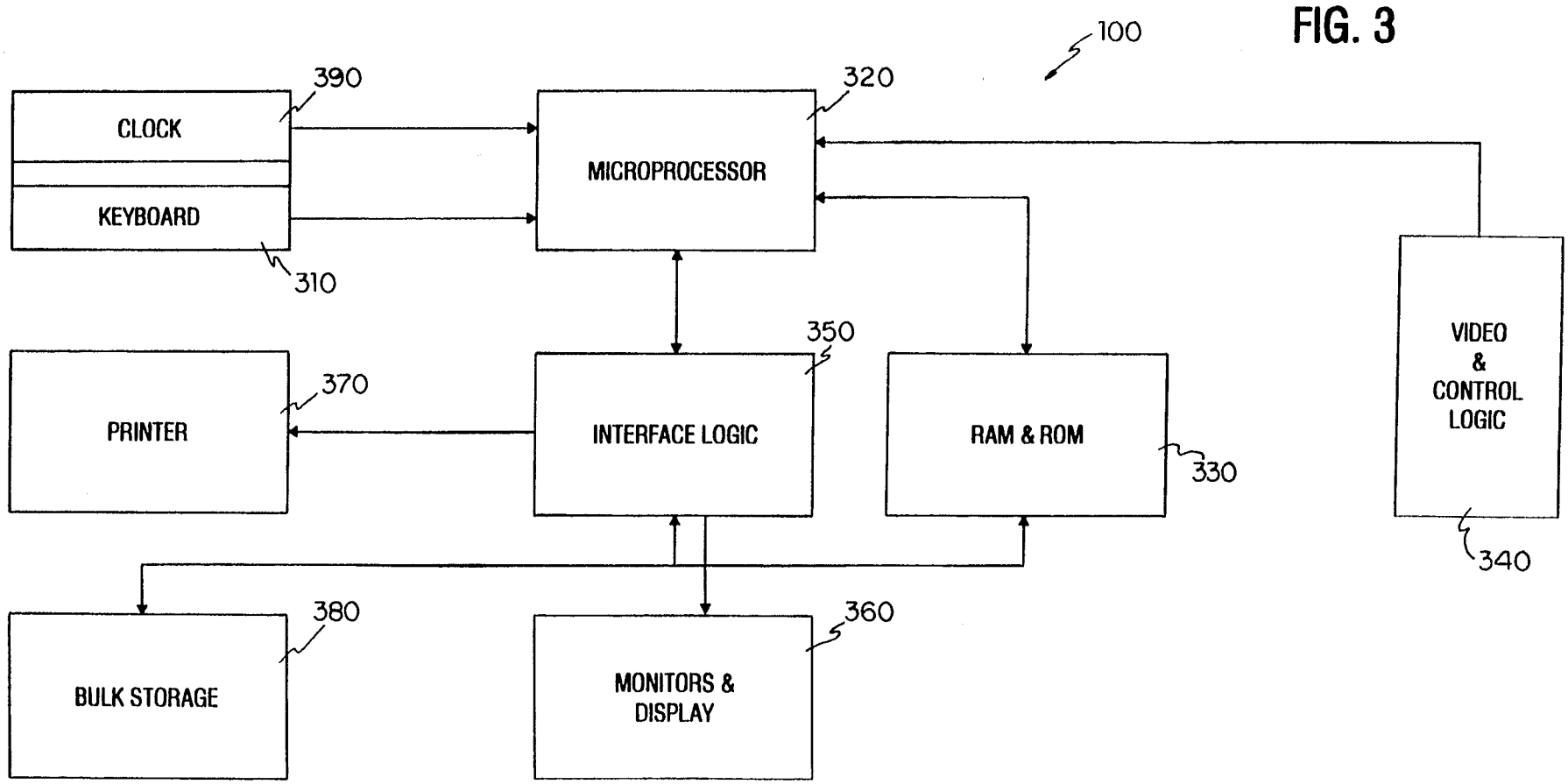
FIG. 3 is a block diagram showing the interrelationship of the various elements of the present invention.
Figure 4:
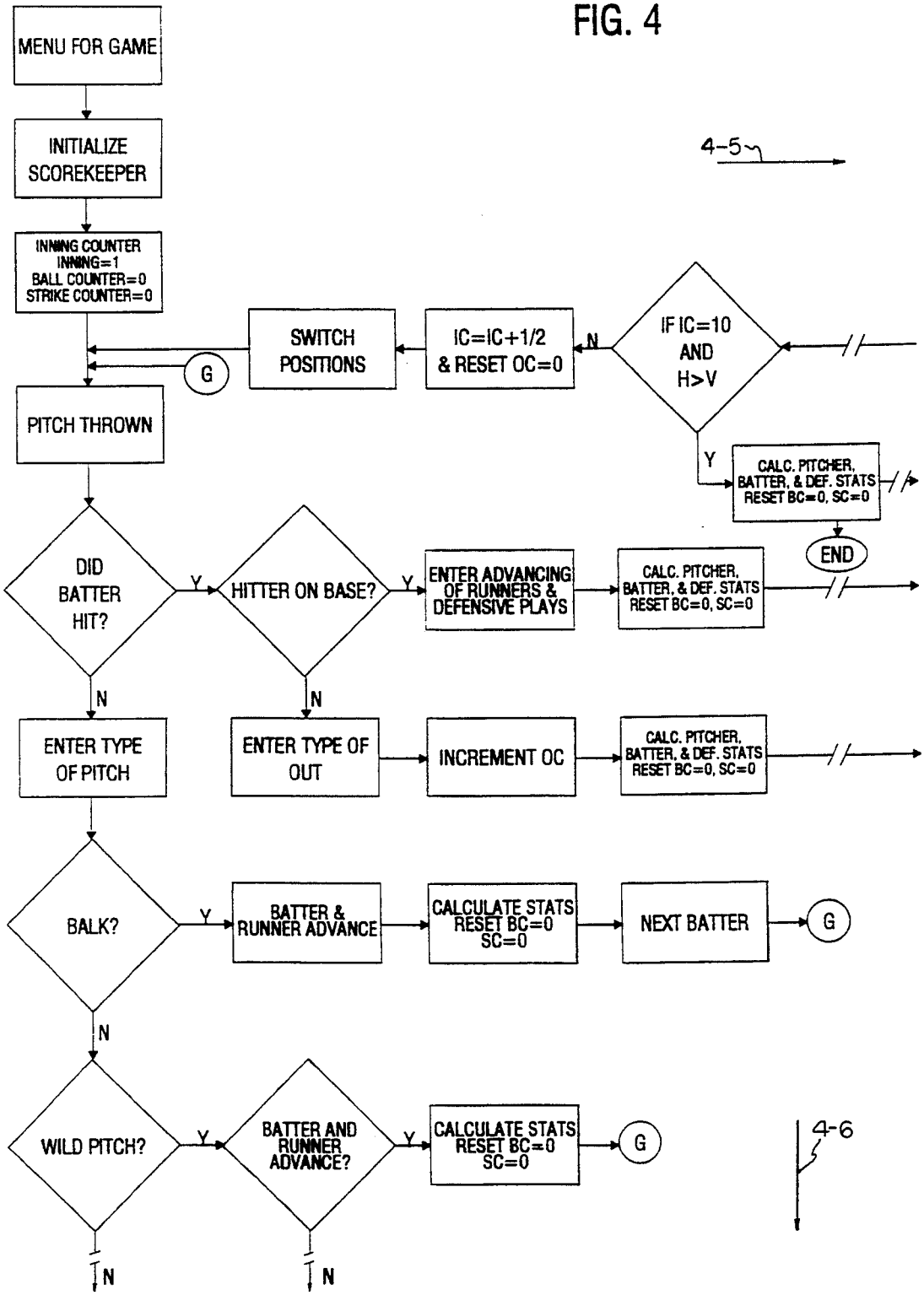
FIGS. 4–8 make up a flow chart showing an example of an algorithm that would be used for a baseball scorekeeping version of the present invention.
Figure 5:
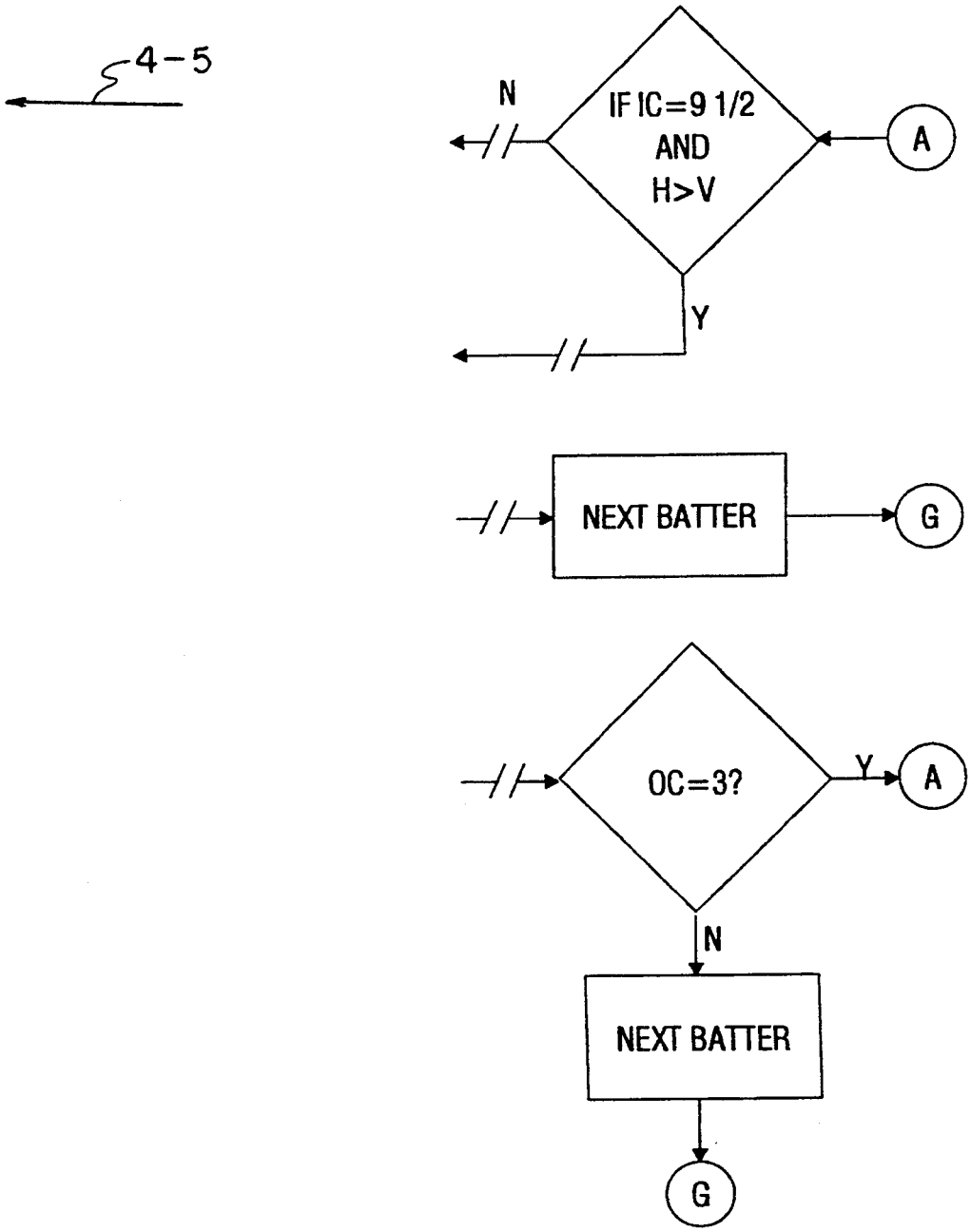
Figure 6:
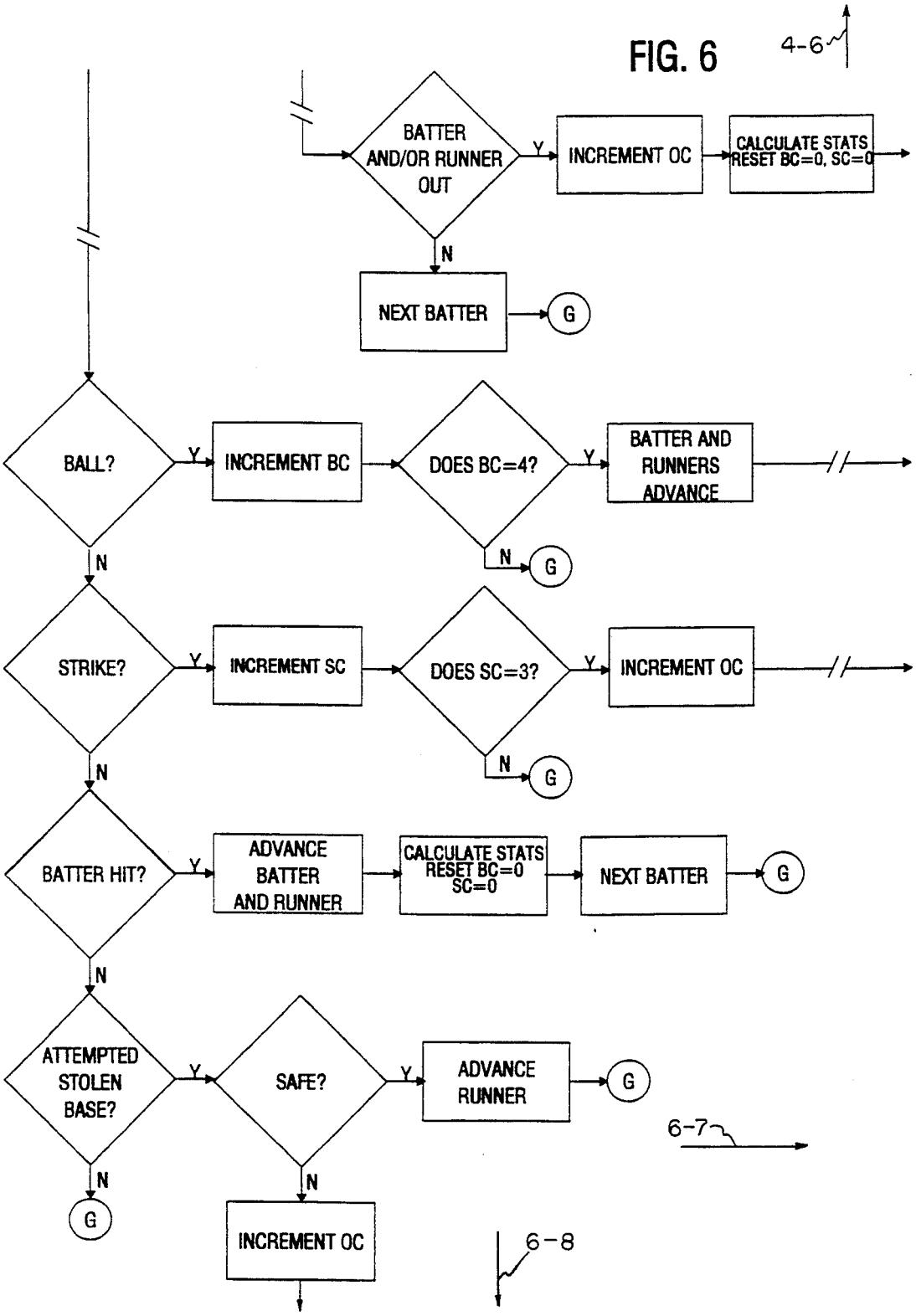
Figure 7:
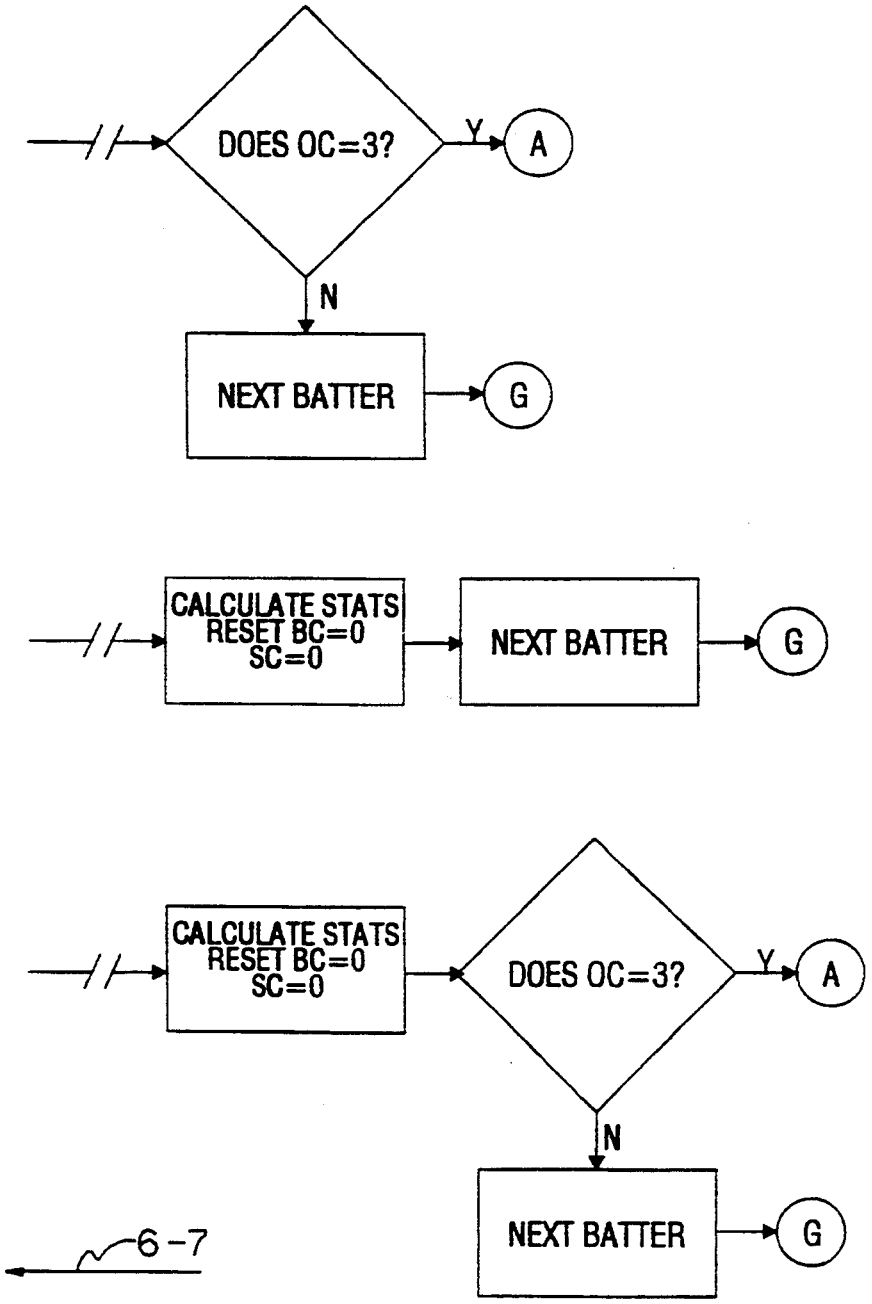
Figure 8:
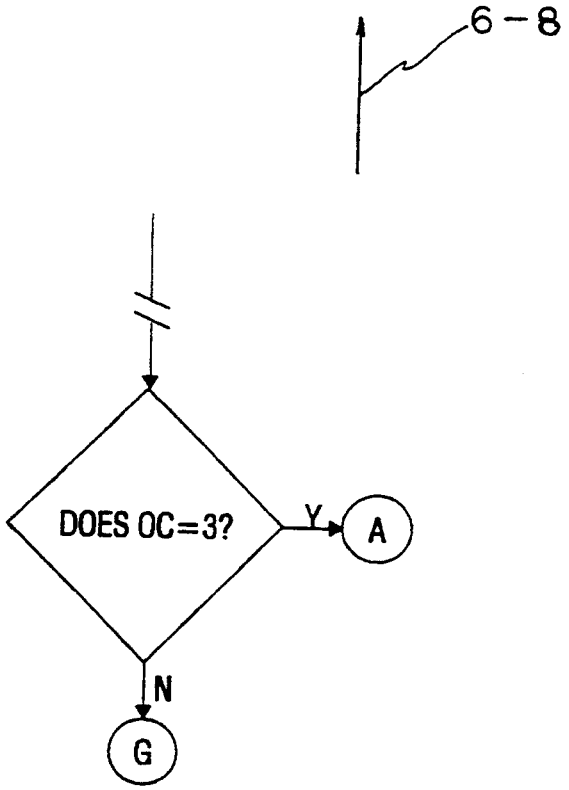

Referring to FIG. 3, a block diagram depicts the interrelationship of the electronic components of device 100. Keyboard 310 include the alphanumeric keyboard 101 and function keys 102 of FIG. 1. Microprocessor 320 in combination with the operational software stored in memory device 330 calculates, updates, and stores current team statistics and the offensive and defensive statistics of each player after each play event is entered via keyboard 310. Memory device 330 includes RAM to store the updated statistics and ROM to store the operational software. Microprocessor 320 in conjunction with video and control logic 340 and interface logic 350 controls and updates the outputs to monitors and display 360 after each play event is input. Printer 370 is used to print a hard copy of the play events and player data. Bulk storage 380 is used to store the play events and player data of previously scored games. Bulk storage 380 can be built into device 100 similar to a conventional computer hard drive or it can be a conventional floppy disk. Clock 390 is used to record time and date information regarding the game.

FIGS. 4–8 show a flow chart which describes the algorithm that operates a baseball scoring version of device 100. Arrows 4–5, 4–6, 6–7, and 6–8 should be aligned to show the proper relationship of the four sheets forming the complete flow chart. The device is initialized by setting the time and date of the game, the team names and each team's line up in conjunction with each player's defensive position and most recent offensive and defensive statistics.. Miscellaneous information to be input during the initialization of the device is the site, the umpires and the coaches.

Once device 100 is initialized play events can be input and stored. The results of each play event is used to updated the statistics of the pitcher, the batter and the affected defensive players.

The statistics of the pitcher includes balls, strikes, base on balls, hit batters, wild pitches, innings pitched, games started, games completed, innings of relief, games saved, batters faced, balks, games played, games lost, earned runs, and earned run average.

The statistics of a batter includes number of times at bat, hits, runs scored, runs batted in, singles, doubles, triples, home runs, base on balls, times hit by pitch, times reached base because of defensive error, sacrifices, stolen bases, strike outs, on base percentage, games played, innings played and slugging percentage.

The statistics of a defensive player includes number of errors, put outs, fielding percentage and assists.

Though the device herein described relates to the game of baseball, it should be noted that other sports could be scored, and records kept of the pertinent statistics, utilizing this device. For example, softball, soccer, hockey, basketball, and football could be scored by modifying the displays on the device and the operating algorithm or software.

It is to be understood that the present invention is not limited to the sole embodiment described above, but encompasses any and all embodiments within the scope of the following claims.

I claim:

1. A portable electronic scorekeeping device for sports comprising:

first means for inputting player data including names of players with their defensive position in accordance with a predetermined order and the player's present offensive and defensive statistics, said first means including a first plurality of touch-sensitive switches;

second means for inputting each play event as it occurs, said second inputting means including a second plurality of touch sensitive switches proximate said first plurality of touch sensitive switches;

first storage means for storing control logic, said control logic defining a protocol for updating said offensive and defensive statistics, said first storage means comprising at least read only memory;

second storage means for storing said player data from said first input means, said second storage means comprising at least random access memory;

means for updating said offensive and defensive statistics according to said play event input via said second inputting means and said protocol; and means for visually displaying data including a representation of predetermined player data, said predetermined data selected by said update means, said display means further including a playing surface display configured so a visual representation of the playing surface and locations of players on the playing surface are provided.

2. The portable electronic scorekeeping device according to claim 1, further comprising third storage means for storing said player data and said play events from previously scored games.

3. The portable electronic scorekeeping device according to claim 2, wherein said third storage means comprises at least a hard disk.

4. The portable electronic scorekeeping device according to claim 1, further comprising printing means for printing a hard copy of said player data.

5. The portable electronic scorekeeping device according to claim 1, further comprising interface means for interfacing said scorekeeping device to a publicly viewed scoreboard.

6. The portable electronic scorekeeping device according to claim 1, further comprising sound emitting means for emitting an audible confirmation of said input player data and said play events.

7. The portable electronic scorekeeping device according to claim 6, wherein said sound emitting means comprises at least a voice synthesizer.

8. The portable electronic scorekeeping device according to claim 1, wherein said display means comprises at least a first display for displaying an outcome of each inning for a home team and a visiting team for

9. The portable electronic scorekeeping device according to claim 8, wherein said display means comprises at least a second display for displaying a current total of runs, hits and errors for a baseball game.

10. The portable electronic scorekeeping device according to claim 9, wherein said display means comprises at least a third display for displaying player names and defensive positions for a baseball game in said predetermined order, whereby said predetermined order is a starting lineup.

11. The portable electronic scorekeeping device according to claim 10, wherein said display means comprises at least a fourth display for displaying a player name and offensive and defensive statistics for an individual player for a baseball game.

12. The portable electronic scorekeeping device according to claim 11, wherein said playing surface display is configured so a baseball diamond is displayed and provides a visual notification when players are on base.

13. The portable electronic scorekeeping device according to claim 12, wherein said playing surface display comprises at least:

light emitting diodes to indicate when players are on base.

14. The portable electronic scorekeeping device according to claim 12, wherein said playing surface display comprises at least:

a graphical video screen for providing graphical representation when players are on base.

15. The portable electronic scorekeeping device according to claim 12, wherein said display means further comprise a current total display for displaying the current total of balls, strikes and outs.

* * * * *